US009974390B2

(12) United States Patent
Tsai

(10) Patent No.: US 9,974,390 B2
(45) Date of Patent: May 22, 2018

(54) ARMREST

(71) Applicant: JENP-JOU ENTERPRISE CO., LTD., Tainan (TW)

(72) Inventor: Po-Chuan Tsai, Tainan (TW)

(73) Assignee: JENP-JOU ENTERPRISE CO., LTD., Tainan (TW)

( * ) Notice: Subject to any disclaimer, the term of this patent is extended or adjusted under 35 U.S.C. 154(b) by 166 days.

(21) Appl. No.: 15/240,377

(22) Filed: Aug. 18, 2016

(65) Prior Publication Data

US 2018/0049552 A1 Feb. 22, 2018

(51) Int. Cl.
*A47C 7/54* (2006.01)

(52) U.S. Cl.
CPC ..... *A47C 7/54* (2013.01)

(58) Field of Classification Search
None
See application file for complete search history.

(56) References Cited

U.S. PATENT DOCUMENTS 5,829,839 A * 11/1998 Wilkerson ..... A47C 1/03 297/411.36
8,939,512 B2 * 1/2015 Boes ..... B60N 2/4882 297/408
9,901,175 B2 * 2/2018 Chen ..... A47C 7/54
2004/0183355 A1 * 9/2004 Lee ..... A47C 1/03 297/411.36
2009/0243364 A1 * 10/2009 Brunner ..... B60N 2/815 297/408
2013/0033082 A1 * 2/2013 Huang ..... A47C 1/03 297/411.36
2014/0167478 A1 * 6/2014 Bauer ..... A47C 7/54 297/411.38
2016/0135602 A1 * 5/2016 Smith ..... A47C 7/14 297/115
2017/0318966 A1 * 11/2017 Chen ..... A47C 7/54

* cited by examiner

*Primary Examiner* — David E Allred
(74) *Attorney, Agent, or Firm* — Kirton McConkie; Evan R. Witt

(57) ABSTRACT

An armrest includes a shell convertible between a fixed position and a non-fixed position, a lock unit, and a control unit. The lock unit includes a base seat and two pivot gears, each of which has an arm segment and a gear segment having a plurality of first teeth. The control unit includes a rack having a plurality of second teeth and is operable to move between a locking position and an unlocking position. When the control unit is at the locking position, the second teeth mesh with the first teeth, the pivot gears are locked, and the shell is at the fixed position. When the control unit is at the unlocking position, the rack is away from the pivot gears, the pivot gears are pivotally rotatable, and the shell is at the non-fixed position.

7 Claims, 8 Drawing Sheets

ARMREST

FIELD

The disclosure relates to an armrest, and more particularly to an armrest that is adjustable in position through a movement along a horizontal surface.

BACKGROUND

In general, a conventional chair has two chair armrests. In order to provide more comfort, some conventional chair armrests are designed to be movable in a front-rear direction and a left-right direction for adjusting the chair armrests forward, rearward, rightward or leftward. A conventional armrest whose position is adjustable along a horizontal surface is disclosed in Taiwanese Patent No. I353822, and includes a bottom seat, a cap body, a fixing device, and an adjusting member disposed between the bottom seat and the cap body. The fixing device includes a base plate having a plurality of first tooth portions, a fixing plate having two rows of second tooth portions, and two gears disposed at two opposite sides of the fixing plate and respectively mesh with the second tooth portions of the fixing plate. The adjusting member has two racks, one of the racks having a plurality of first rack teeth capable of meshing with the first tooth portions of the base plate, and the other one of the racks having a plurality of second rack teeth capable of meshing with the gears. When the first rack teeth mesh with the first tooth portions of the base plate, and when the second rack teeth mesh with the gears, the bottom seat and the cap body are locked against movement. When the first rack teeth are away from the first tooth portions of the base plate, and when the second rack teeth are away from the gears, a user may grip the bottom seat and the cap body with his/her hand to move the same in the front-rear direction and the left-right direction to adjust the position of the armrest.

SUMMARY

Therefore, the object of the disclosure is to provide an armrest that has an innovative structure and that can be conveniently adjusted in position through a horizontal movement.

According to the disclosure, the armrest is adapted to be mounted to an armrest post of a chair, and includes a shell, a lock unit and a control unit. The shell is movably mounted to the armrest post, defines a receiving space, and is convertible between a fixed position and a non-fixed position. When the shell is at the non-fixed position, the shell is operable to move in a first direction relative to the armrest post and a second direction transverse to the first direction. The lock unit is mounted in the receiving space, and includes a base seat disposed in the shell and immovably connected to the armrest post, and two pivot gears pivotally connected to the base seat and spaced apart from each other in the first direction. Each of the pivot gears has an arm segment having one end that is pivotally connected to the base seat, and a gear segment connected to the other end of the arm segment and having a plurality of first teeth. The control unit includes a rack having a plurality of second teeth that protrude toward the first teeth and that are arranged in the first direction, and is operable to move between a locking position and an unlocking position. When the control unit is at the locking position, the second teeth of the rack mesh with the first teeth of the pivot gears, the pivot gears are locked, and the shell is at the fixed position. When the control unit is at the unlocking position, the rack is away from the pivot gears, the pivot gears are pivotally rotatable, and the shell is at the non-fixed position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
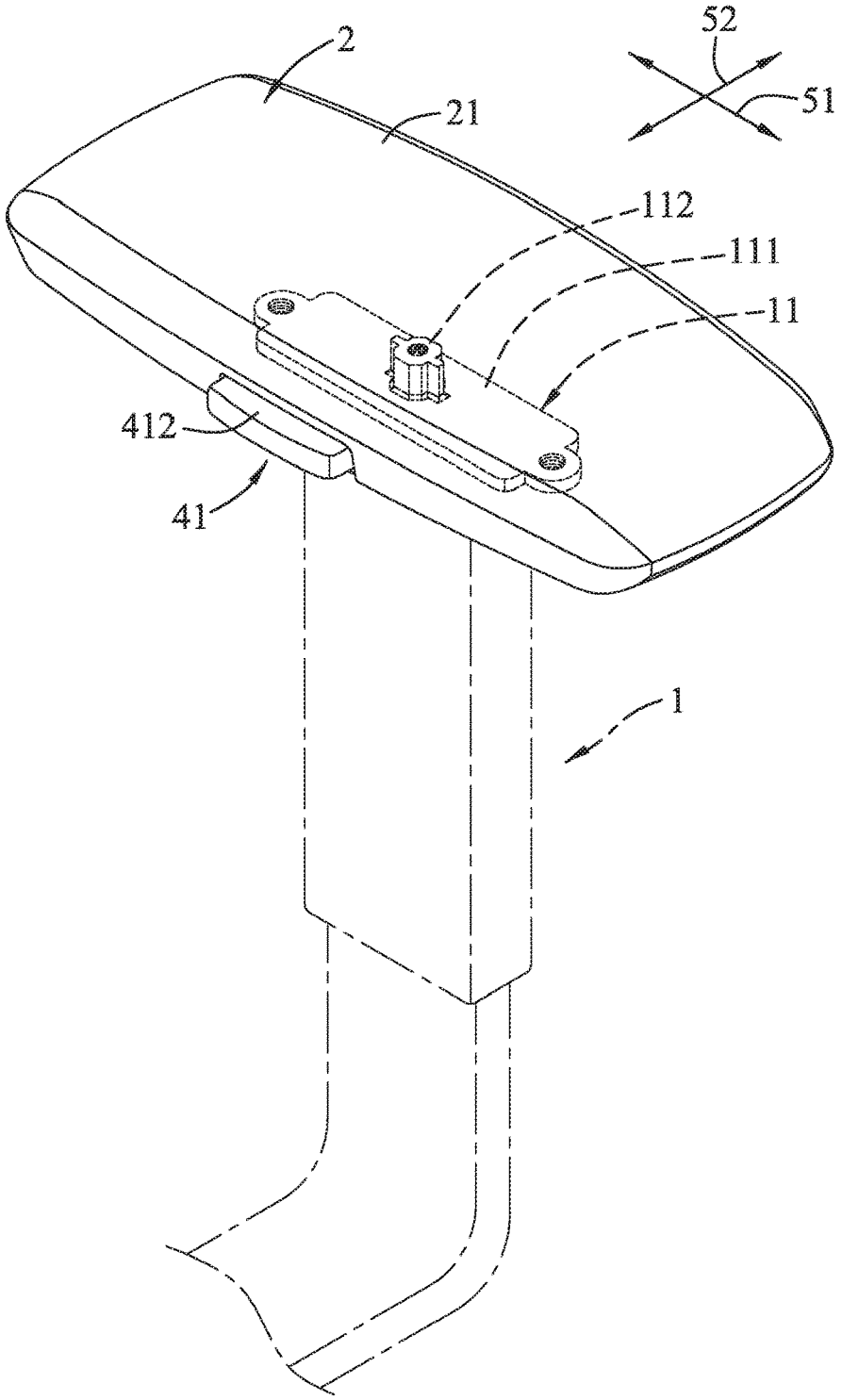
FIG. 1 is a perspective view illustrating an embodiment of an armrest mounted to an armrest post according to the disclosure.

As shown in FIGS. 1 to 4, the embodiment of an armrest according to the disclosure is adapted to be mounted to an armrest post 1 of a chair. The armrest post 1 includes a mounting member 11 disposed on a top end portion thereof, and having a mounting wall 111 that extends horizontally, and a coupling member 112 that protrudes upwardly from the mounting wall 111. The armrest includes a shell 2, a lock unit 3 and a control unit 4.

The shell 2 is movably mounted to the top end portion of the armrest post 1, and is convertible between a fixed position and a non-fixed position. When the shell 2 is at the non-fixed position, the shell 2 is operable to move in a first direction 51 relative to the armrest post 1 and a second direction 52 transverse to the first direction 51. The shell 2 has spaced apart bottom and top walls 22, 23, and a surrounding wall 24 connected between outer edges of the bottom and top walls 22, 23, and defining a receiving space 20 with the bottom and top walls 22, 23. In this embodiment, the shell 2 is formed by assembling together upper and lower shell halves 21. The bottom wall 22 extends in the first direction 51 and has a mounting hole 221 communicating with the receiving space 20. The surrounding wall 22 has first and second inner wall surfaces 241, 242 spaced apart in the second direction 52. In this embodiment, the second direction 52 is perpendicular to the first direction 51, the first direction 51 is in a front-rear direction, and the second direction 52 is in a left-right direction. However, the first and second directions may be located in other directions in other embodiments.

The lock unit 3 is mounted in the receiving space 20, and includes a guiding seat 31 disposed on the bottom wall 22 of the shell 2, a base seat 32 mounted on the guiding seat 31, movable relative to the guiding seat 31 in the second direction 52, and immovably connected to the armrest post 1, and two pivot gears 33 pivotally connected to the base seat 32 and spaced apart from each other in the first direction 51.

The guiding seat 31 is disposed in the receiving space 20, is simultaneously movable with the shell 2 in the second direction 52, and has a limiting groove 311 disposed for disposition of the base seat 32 thereonto, a coupling hole 312 extending downwardly from the limiting groove 311 and aligned with the mounting hole 221 of the shell 2, and two guiding grooves 313 spaced apart from each other in the first direction 51 and disposed at opposite two sides of the limiting groove 311. Each of the guiding grooves 313 is elongated in the first direction 51, and has a first end 314 close to the other one of the guiding grooves 313 and a second end 315 opposite to the first end 314. The base seat 32 is disposed in the limiting groove 311, and is connected to the armrest post 1 through the coupling hole 312 and the mounting hole 221 of the shell 2. In particular, the coupling member 112 of the armrest post 1 extends upwardly through the mounting hole 221 of the shell 2 and the coupling hole 312 of the lock unit 3 into the base seat 32, and the base seat 32 and the coupling member 112 are securely coupled together with a screw 321.

Figure 2:
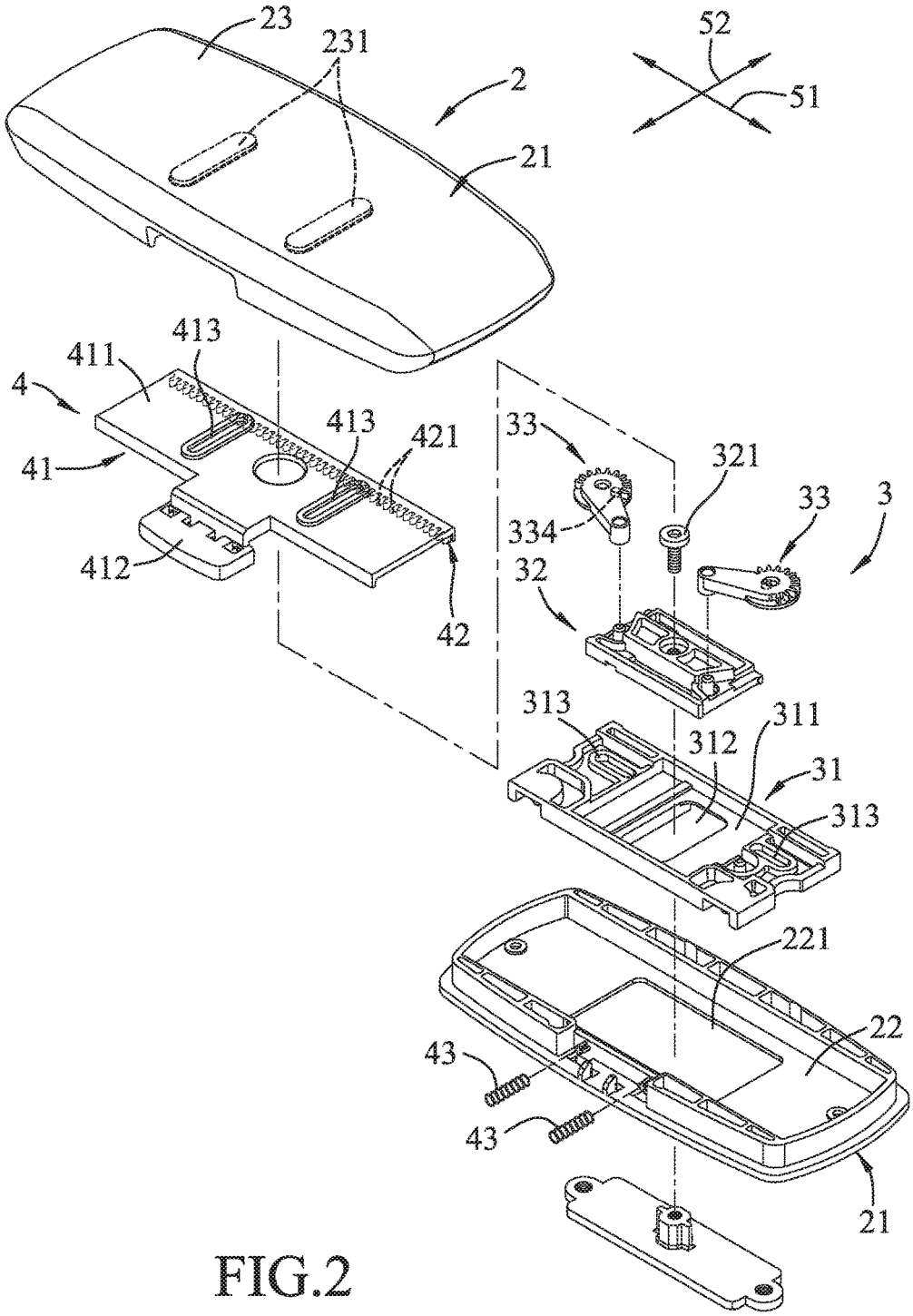
FIG. 2 is an exploded perspective view of the embodiment.
Figure 4:
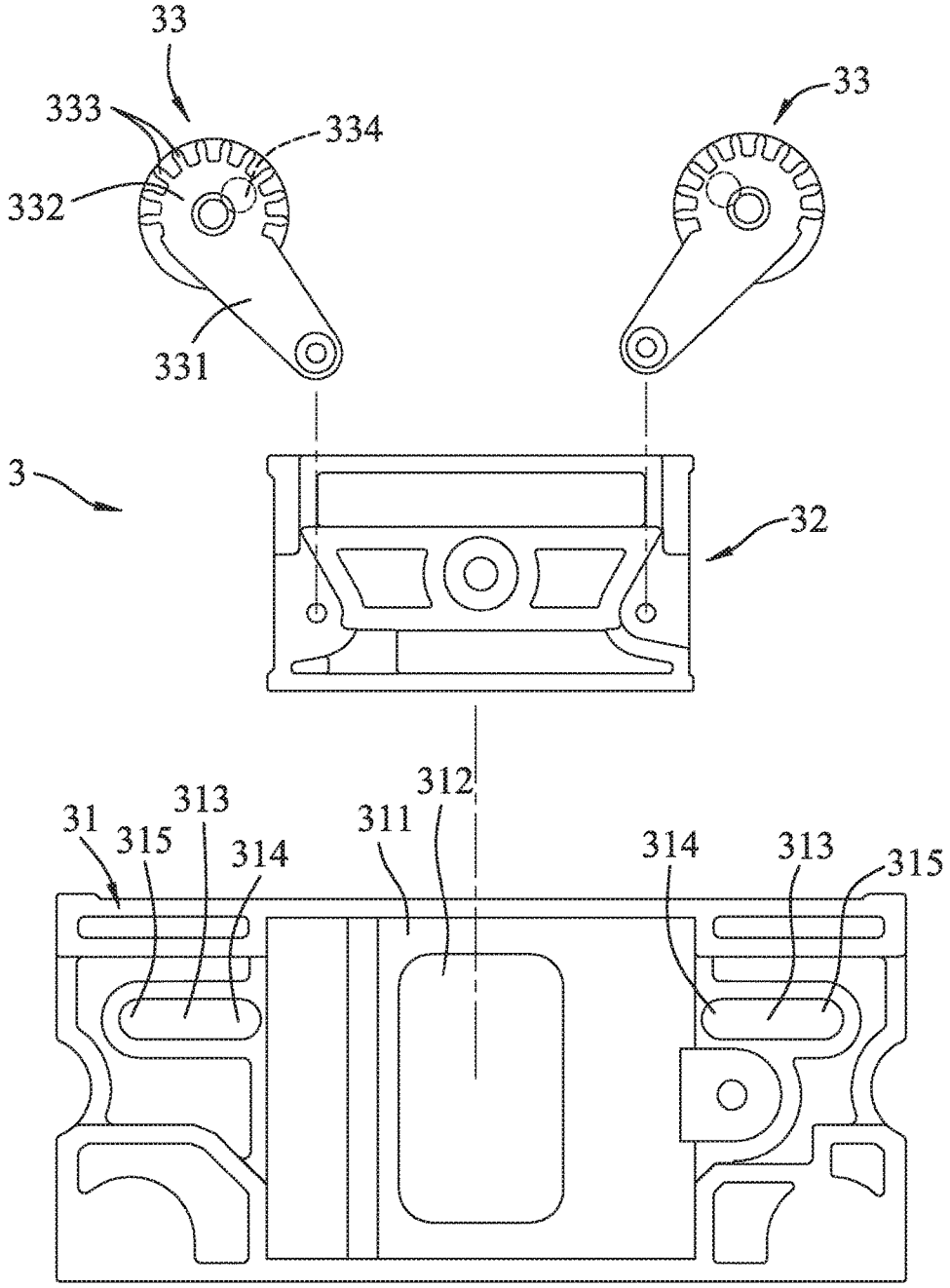
FIG. 4 is a partly exploded top view of a lock unit of the embodiment.
Figure 5:
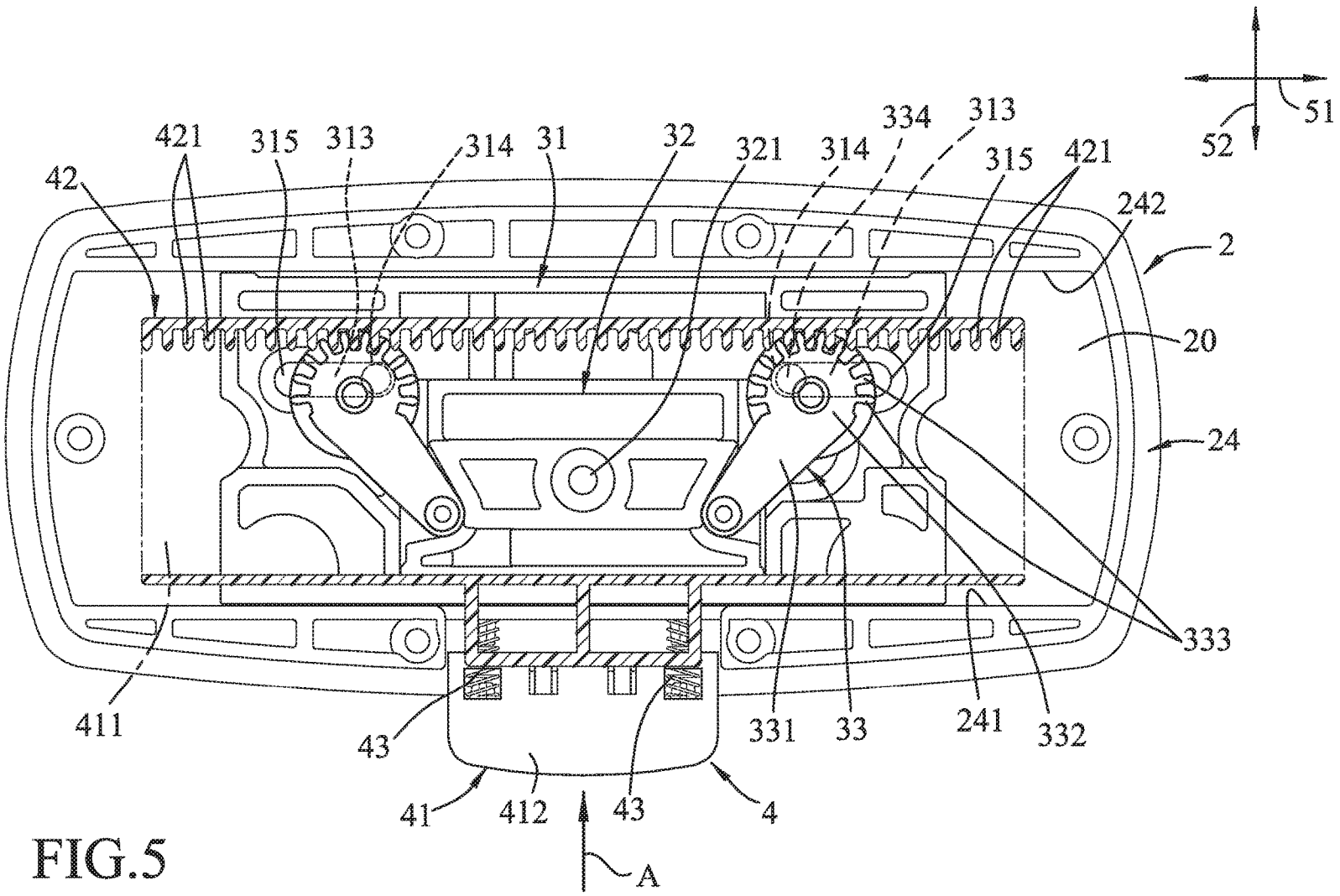
FIG. 5 is a top sectional view illustrating a control unit of the embodiment at a locking position.

As shown in FIGS. 2, 4 and 5, each of the pivot gears 33 has an arm segment 331 having one end pivotally connected to the base seat 32, and a gear segment 332 connected to the other end of the arm segment 331. Each of the gear segments 332 is disposed on and movable along a respective one of the guiding grooves 313, and has a plurality of first teeth 333, and a guiding rod 334 extending into the respective one of the guiding grooves 313 and movable between the first end 313 and the second end 314.

The control unit 4 is mounted in the receiving space 20, and includes a control member 41, a rack 42 connected to the control member 41, and at least one resilient member 43. In this embodiment, the control unit 4 includes two resilient members 43 spaced apart from each other in the first direction 51. The control member 41 and the rack 42 are formed as one piece.

Figure 3:
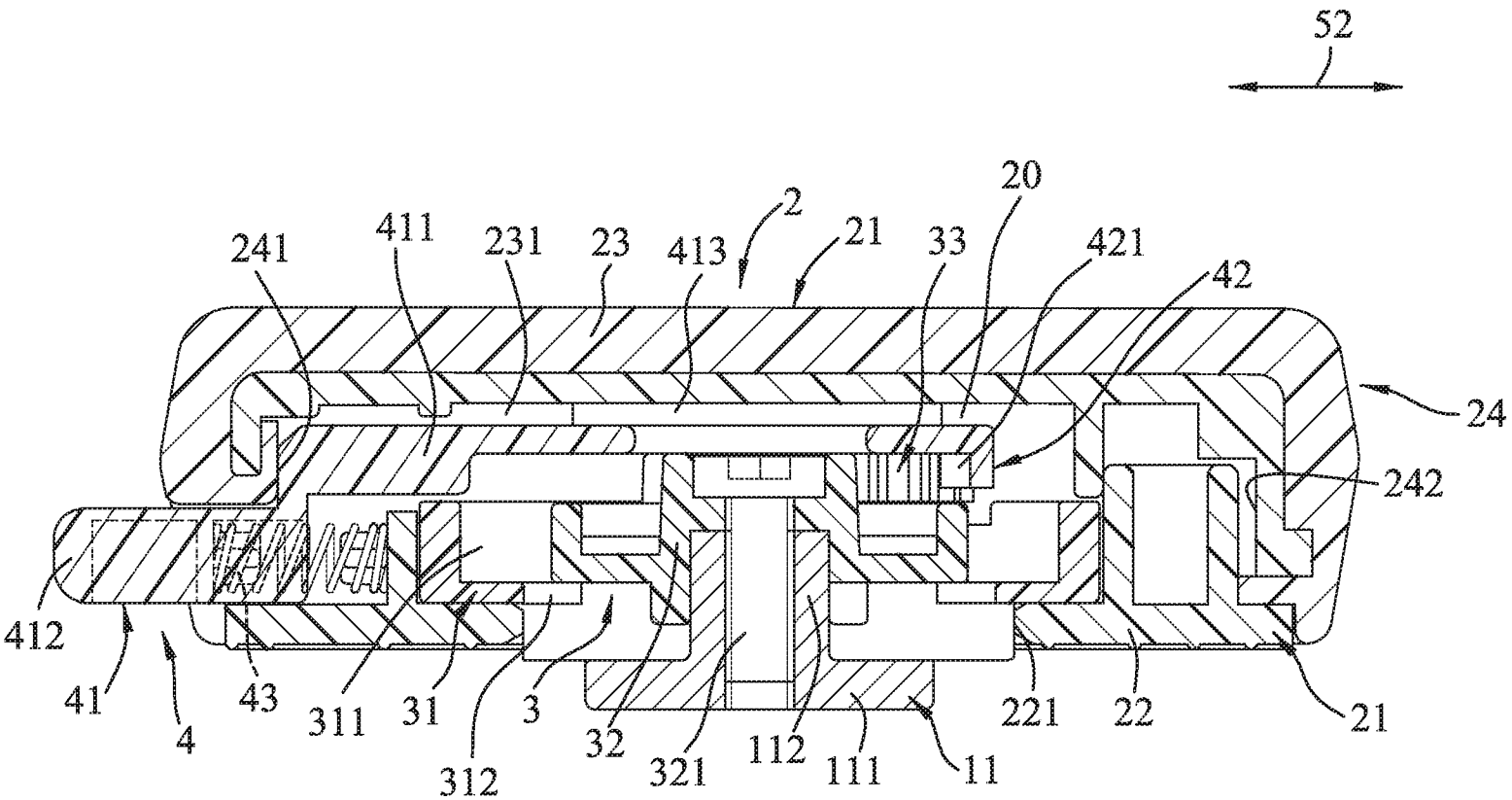
FIG. 3 is a side sectional view of the embodiment.

As shown in FIGS. 2, 3 and 5, the control member 41 has a main plate 411 disposed in the receiving space 20 and mounted on the lock unit 3, and an operating plate 412 protruding out of the first wall section 241 of the shell 2 from the main plate 411. The rack 42 is connected to one end of the main plate 411 of the control member 41, which is opposite to the operating plate 412 and disposed between the second wall section 242 of the shell 2 and each of the pivot gears 33. The rack 42 has a plurality of second teeth 421 formed on a bottom surface of the main plate 411, protruding toward the first teeth 333, and arranged in the first direction 51. The resilient members 43 are disposed between the operating plate 412 of the control member 41 and the surrounding wall 24 of shell 2, and are disposed for offering a resilient force to bias the rack 42 and the control member 41 toward the first inner wall surface 241 of the surrounding wall 24.

Figure 6:
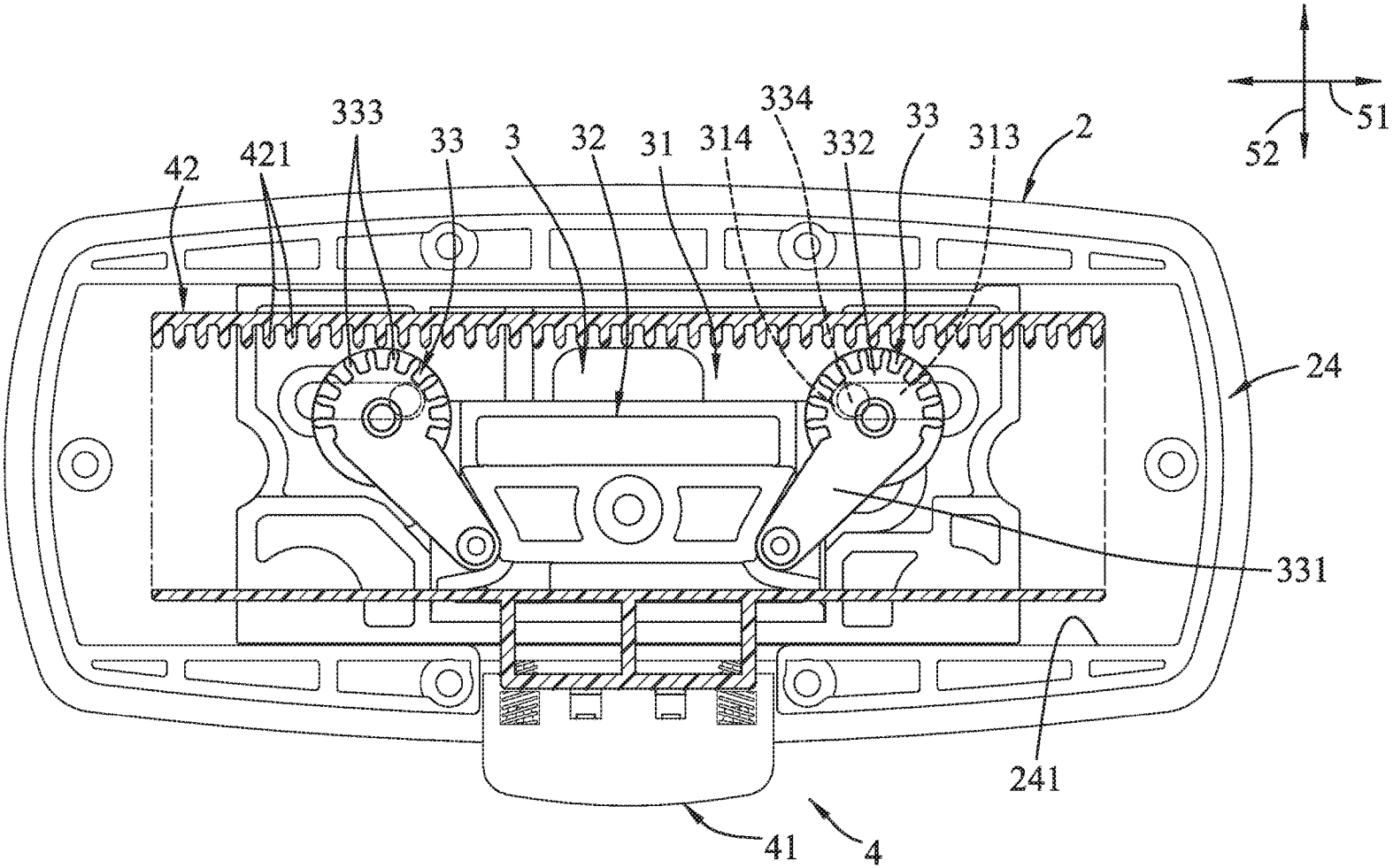
FIG. 6 is a view similar to FIG. 5, but illustrating the control unit at unlocking position.

As shown in FIGS. 1, 5 and 6, in operation, the control unit 4 is operable to move between a locking position as shown in FIG. 5 and an unlocking position as shown in FIG. 6. When the control unit 4 is at the locking position, the second teeth 421 of the rack 42 mesh with the first teeth 333 of the pivot gears 33. Since the control member 41 is resiliently pushed by the resilient members 43, the rack 42 securely meshes with the pivot gears 33 so that the pivot gears 33 are locked and the shell 2 is at the fixed position. At this moment, the shell 2 cannot move relative to the armrest post 1.

To adjust the position of the shell 2 relative to the armrest post 1, the operating plate 412 of the control member 41 may be pressed in a direction indicated by an arrow (A) as shown in FIG. 5 to drive the rack 42 to move toward the second inner wall surface 242 of the surrounding wall 24 in the second direction 52. As a result, the control unit 4 is placed at the unlocking position. At this moment, the rack 42 is away from the pivot gears 33, the second teeth 421 are not meshed with the first teeth 333, the pivot gears 33 are pivotally rotatable, and the shell 2 is at the non-fixed position and is movable relative to the armrest post. The shell 2 may therefore be operated to move in the first direction 51 and the second direction 52.

Figure 7:
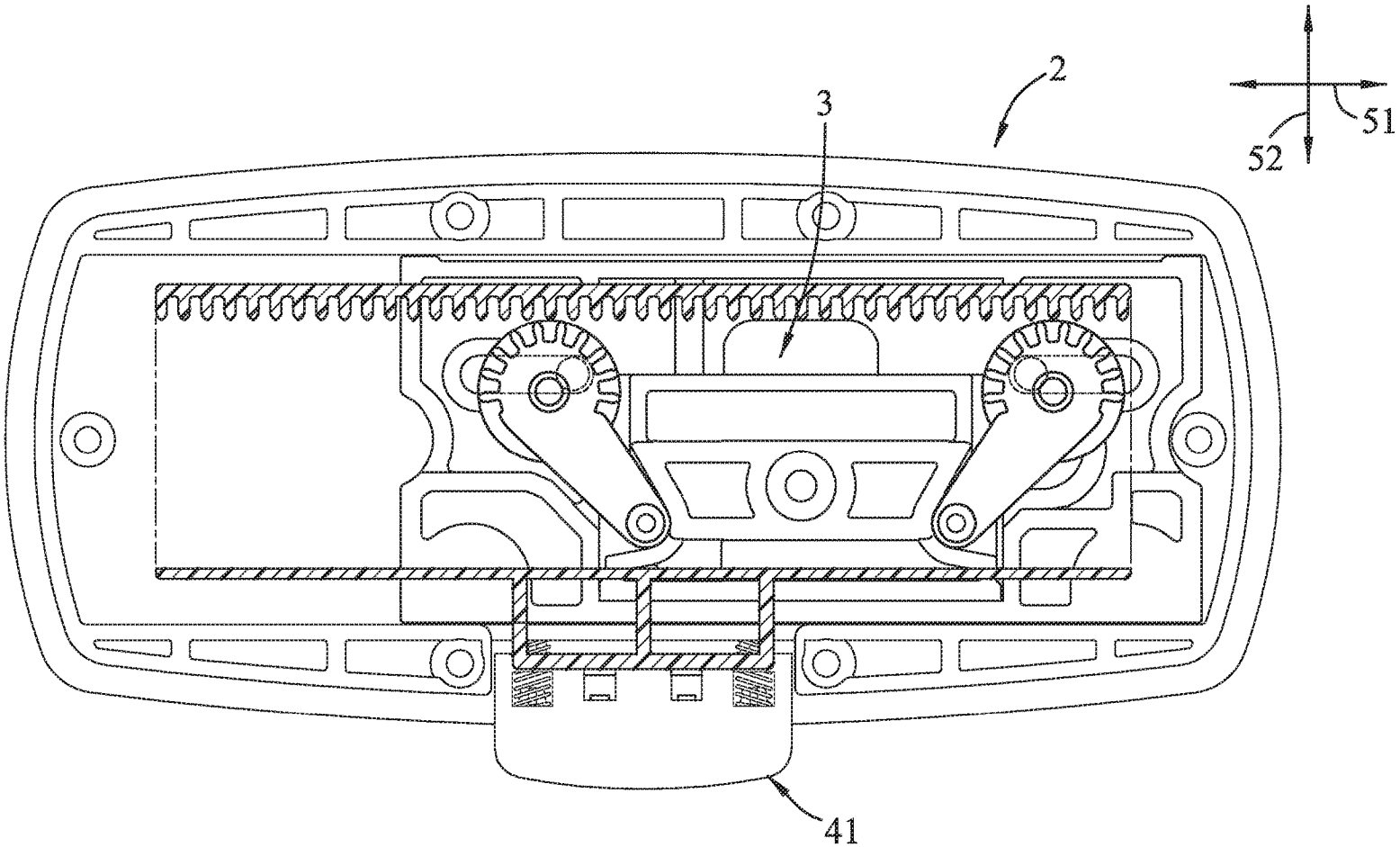
FIG. 7 is a view similar to FIG. 6, but illustrating a shell of the embodiment moved in a first direction.

As shown in FIGS. 6 and 7, to adjust the position of the shell 2, a user may grip the shell 2 with a hand, press the control member 41 with a thumb, and simultaneously move the shell 2 with the hand while the control member 41 is being pressed. When the shell 2 moves in the first direction 51, the lock unit 3 remains unmoved.

Figure 8:
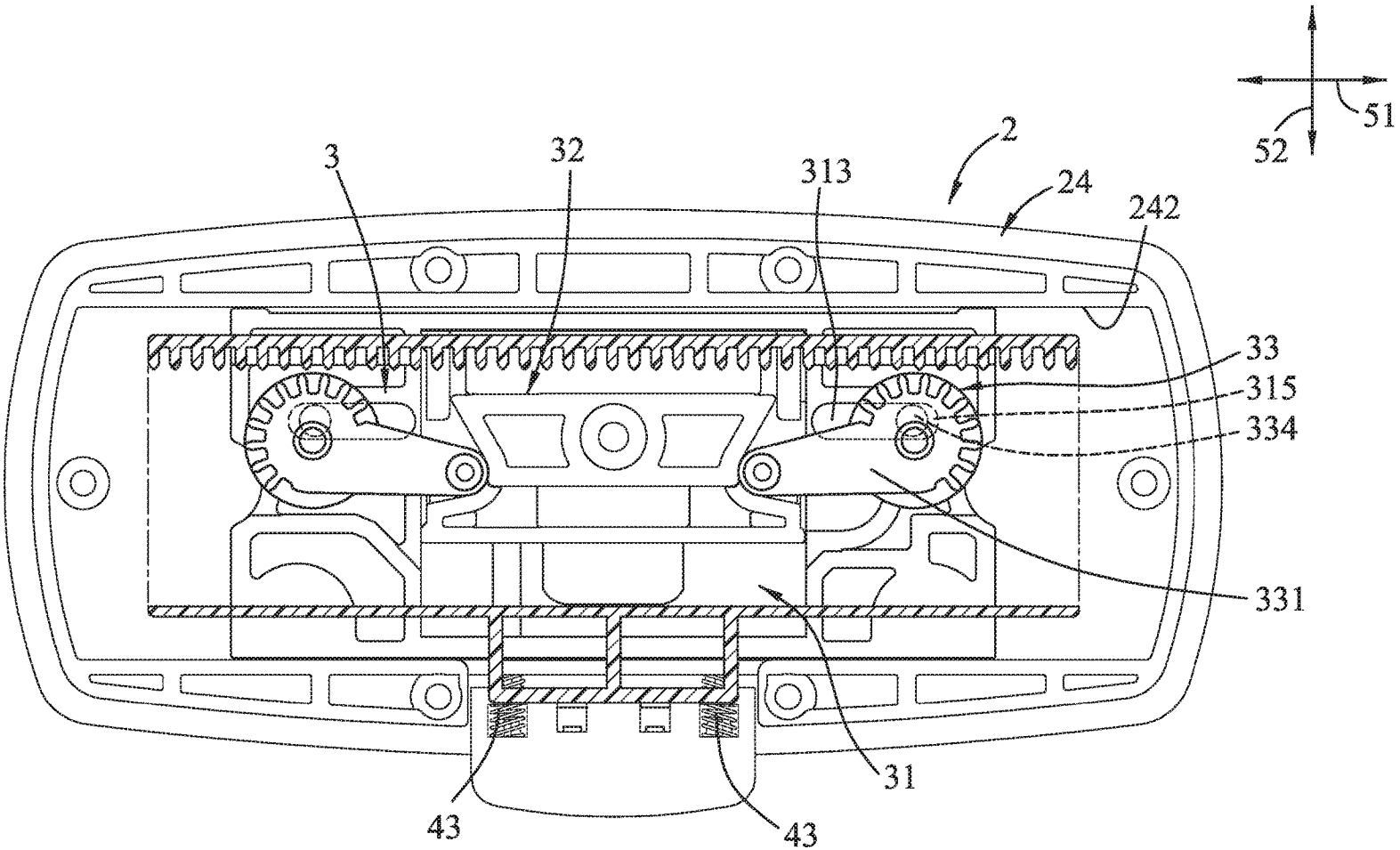
FIG. 8 is a view similar to FIG. 6, but illustrating the shell moved in a second direction.

As shown in FIGS. 1, 6 and 8, when the shell 2 moves in the second direction 52, the guiding seat 31 of the lock unit 3 moves simultaneously with the shell 2. However, the base seat 32 is immovable on the armrest post 1 since the base seat 32 is securely connected to the coupling member 112 of the armrest post 1. Besides, for each of the pivot gears 33, the arm segment 331 is pivotally connected to the base seat 32 and forms a pivot connection, and the guiding rod 334 extends into the respective one of the guiding grooves 313 of the guiding seat 31. Therefore, when the shell 2 moves in the second direction 52, each of the pivot gears 33 pivotally rotates about its pivot connection as a pivot center. When the base seat 32 is proximate to the first inner wall surface 241 of the surrounding wall 24 of the shell 2 as shown in FIG. 6, the guiding rod 334 of each of the pivot gears 33 is located at the first end 314 of the respective one of the guiding grooves 313, and when the shell 2 moves in the second direction 52 to a location where the base seat 32 is proximate to the second inner wall surface 242 of the surrounding wall 24 of the shell 2, the guiding rod 334 of each of the pivot gears 33 is located at the second end 315 of the respective one of the guiding grooves 313.

As shown in FIG. 5, after the user moves the shell 2 to a preferred position, a pressing force applied to the control member 41 by the user may be removed. Accordingly, the control member 41 and the rack 42 are urged by the resilient members 43 to move toward the first inner wall surface 241 of the shell 2. The control unit 2 thus returns back to the locking position, so that the rack 42 meshes with the pivot gears 33 to lock the shell 2 at the preferred position.

In conclusion, with the inter-engageable relationship of the rack 42 and the pivot gears 33, the shell 2 is convertible between the fixed position and the non-fixed position. Besides, with the pivotally rotatable design of the pivot gears 33, the shell 2 is movable either in the first direction 51 or the second direction 52 when the control unit 4 is at the unlocking position. Adjustment of the armrest is convenient because the position of the shell 2 may be readily changed by merely moving the control unit 4 to the unlocking position.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An armrest adapted to be mounted to an armrest post of a chair, said armrest comprising:

a shell configured to be movably mounted to the armrest post, and defining a receiving space, said shell being convertible between a fixed position and a non-fixed position, wherein, when said shell is at the non-fixed position, said shell is operable to move in a first direction relative to the armrest post and a second direction transverse to the first direction;

a lock unit mounted in said receiving space, and including a base seat that is disposed in said shell and that is immovably connected to the armrest post, and two pivot gears that are pivotally connected to said base seat and that are spaced apart from each other in the first direction;

each of said pivot gears having an arm segment that has one end pivotally connected to said base seat, and a gear segment that is connected to the other end of said arm segment and that has a plurality of first teeth; and a control unit including a rack that has a plurality of second teeth protruding toward said first teeth and arranged in the first direction, said control unit being operable to move between a locking position and an unlocking position, wherein, when said control unit is at the locking position, said second teeth of said rack mesh with said first teeth of said pivot gears, said pivot gears are locked, and said shell is at the fixed position, and when said control unit is at the unlocking position, said rack is away from said pivot gears, said pivot gears are pivotally rotatable, and said shell is at the non-fixed position.

2. The armrest as claimed in claim 1, wherein:

said lock unit further includes a guiding seat disposed in said receiving space and simultaneously movable with said shell in the second direction;

said guiding seat has two guiding grooves spaced apart from each other in the first direction, each of said guiding grooves having a first end that is close to the other one of said guiding grooves and a second end opposite to said first end;

said base seat is mounted on said guiding seat and is movable relative to said guiding seat in the second direction; and said gear segment of each of said pivot gears is movable along a respective one of said guiding grooves.

3. The armrest as claimed in claim 2, wherein:

said shell has a bottom wall disposed beneath said guiding seat and having a mounting hole that communicates with said receiving space;

said guiding seat further has a limiting groove located between said guiding grooves and disposed for disposition of said base seat thereonto, and a coupling hole extending downwardly from said limiting groove and aligned with said mounting hole of said shell; and said base seat is connected to the armrest post through said coupling hole and said mounting hole.

4. The armrest as claimed in claim 2, wherein said gear segment of each of said pivot gears further has a guiding rod extending into the respective one of said guiding grooves and movable between said first end and said second end.

5. The armrest as claimed in claim 4, wherein:

said shell has spaced apart bottom and top walls, and a surrounding wall connected between outer edges of said bottom and top walls and defining said receiving space with said bottom and top walls;

said surrounding wall has first and second inner wall surfaces spaced apart in the second direction; and when said base seat is proximate to said first inner wall surface, said guiding rod of each of said pivot gears is located at said first end of the respective one of said guiding grooves, and when said shell moves in the second direction to a location where said base seat is proximate to said second inner wall surface, said guiding rod of each of said pivot gears is located at said second end of the respective one of said guiding grooves.

6. The armrest as claimed in claim 5, wherein said control unit further includes a control member having a main plate that is mounted on said lock unit and that is connected to said rack, and an operating plate that protrudes out of said shell from said main plate, said operating plate being operable to drive said rack to move toward said second inner wall surface of said surrounding wall in the second direction so that said rack is away from said pivot gears.

7. The armrest as claimed in claim 6, wherein said control unit further includes at least one resilient member disposed between said operating plate of said control member and said surrounding wall of said shell for offering a resilient force to bias said rack and said control member toward said first inner wall surface of said surrounding wall.

* * * * *